US006675734B2

(12) United States Patent
Eagles et al.

(10) Patent No.: US 6,675,734 B2
(45) Date of Patent: Jan. 13, 2004

(54) SPIRAL FORMED FLEXIBLE FLUID CONTAINMENT VESSEL

(75) Inventors: Dana Eagles, Sherborn, MA (US); Bjorn Rydin, Horby (SE); Jan Rexfelt, Halmstad (SE); Crayton Gregory Toney, Wrentham, MA (US); Srinath Tupil, Chelmsford, MA (US); Donald Tripp Lawton, Wayland, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/908,877

(22) Filed: Jul. 18, 2001

(65) Prior Publication Data

US 2002/0178987 A1 Dec. 5, 2002

Related U.S. Application Data

(63) Continuation-in-part of application No. 09/832,739, filed on Apr. 11, 2001.

(51) Int. Cl.[7] ..... B65D 88/78

(52) U.S. Cl. ..... 114/256; 114/74 R; 383/117

(58) Field of Search ..... 114/74 R, 74 T, 114/256; 405/15, 210; 138/129; 383/105, 117, 127, 901, 907

(56) References Cited

U.S. PATENT DOCUMENTS

| | | | |
|---|---|---|---|
| 34,426 A | 2/1862 | Howard | |
| 389,615 A | 9/1888 | Townsend | |
| 1,723,307 A | 8/1929 | Sipe | |
| 1,921,015 A | 8/1933 | Young | |
| 2,065,480 A | 12/1936 | Soper | |
| 2,371,404 A | 3/1945 | Mumford | |
| 2,391,926 A | 1/1946 | Scott | |
| 2,492,699 A | 12/1949 | Houwink | |

(List continued on next page.)

FOREIGN PATENT DOCUMENTS

| | | | |
|---|---|---|---|
| DE | 2413383 | * 10/1975 | ..... 114/256 |
| DE | 198 21 465 A | 11/1999 | |

(List continued on next page.)

OTHER PUBLICATIONS

International Search Report issued by the European Patent Office on Feb. 6, 2003 for PCT/US02/34299.

International Search Report issued by the European Patent Office on Feb. 10, 2003 for PCT/US02/34052.

"3–D Braided Composites—Design and Applications" by D. Brookstein, 6$^{th}$ European Conference on Composite Materials, Sep. 1993, pp. 225–230. Pages from web site of Bradley Industrial Textiles, Inc.

International Search Report issued by European Patent Office on Jul. 9, 2002 for PCT/US02/10694 filed Apr. 5, 2002.

*McGraw–Hill Encyclopedia of Science and Technology, 6$^{th}$ edition,* 1987, McGraw–Hilll Book Company, New York XP002203699 18 pp. 247–248 Paragraph 4; figures 6–8.

International Search Report issued by European Patent Office for corresponding international application PCT/US02/10586 mailed Sep. 26, 2002.

*Primary Examiner*—Sherman Basinger
*Assistant Examiner*—Andrew Wright
(74) *Attorney, Agent, or Firm*—Frommer Lawrence & Haug LLP; Ronald R. Santucci

(57) ABSTRACT

A flexible fluid containment vessel or vessels fabricated out of spirally wound strips of fabric for transporting and containing a large volume of fluid, particularly fresh water, having beam stabilizers, beam separators, reinforcing, and the method of making the same.

59 Claims, 10 Drawing Sheets

U.S. PATENT DOCUMENTS 2,685,964 A 8/1954 Brown
2,724,358 A 11/1955 Harris et al.
2,725,027 A 11/1955 Brandon et al.
2,794,192 A 6/1957 Paris
2,854,049 A 9/1958 Wyllie
2,968,272 A 1/1961 Berglund
2,979,008 A 4/1961 Whipple
2,997,973 A 8/1961 Hawthorne et al.
2,998,793 A 9/1961 Hawthorne et al.
3,001,501 A 9/1961 Hawthorne et al.
3,018,748 A 1/1962 Denis et al.
3,056,373 A 10/1962 Hawthorne et al.
3,067,712 A 12/1962 Doerpinghaus
3,150,627 A 9/1964 Stewart et al.
3,167,103 A 1/1965 Hawthorne et al.
3,224,403 A 12/1965 Paddington
3,282,361 A 11/1966 Mackie
3,289,721 A 12/1966 Benson
3,296,994 A 1/1967 Schirtzinger
3,502,046 A 3/1970 Stauber
3,622,437 A 11/1971 Hobaica et al.
3,661,693 A 5/1972 Pierson
3,672,319 A 6/1972 Platzer
3,739,410 A 6/1973 Fortin
3,762,108 A 10/1973 Pierson
3,774,563 A 11/1973 Anderson, Sr. et al.
3,779,196 A 12/1973 Knaus et al.
3,797,445 A 3/1974 Zeimer
3,812,805 A 5/1974 Forssell et al.
3,839,977 A 10/1974 Bradberry
3,952,679 A 4/1976 Grihangne
3,955,524 A 5/1976 Renoux
3,974,789 A 8/1976 de Groot
4,108,101 A 8/1978 Schirtzinger
4,227,474 A 10/1980 Ullrich
4,227,477 A 10/1980 Preus
4,227,478 A 10/1980 Preus
4,230,061 A 10/1980 Roberts et al.
4,373,462 A 2/1983 Fish
4,399,765 A 8/1983 Alkner et al.
4,429,654 A * 2/1984 Smith, Sr. ..... 114/65 R
4,506,623 A 3/1985 Roper et al.
4,509,558 A 4/1985 Slater
4,510,201 A 4/1985 Takeuchi et al.
4,582,756 A 4/1986 Niinuma et al.
4,662,386 A 5/1987 Pedersen
4,726,986 A 2/1988 Cannady, Jr. et al.
4,733,629 A * 3/1988 Hunt et al. ..... 114/357
4,910,817 A 3/1990 Kita
4,933,231 A 6/1990 Seber
4,998,498 A 3/1991 Gallichan
5,082,726 A 1/1992 Bastiaens et al.
5,194,459 A 3/1993 Sato et al.
5,203,272 A 4/1993 Kassinger et al.
5,235,928 A 8/1993 Shank, Jr.
5,243,925 A 9/1993 Fortenberry
5,262,230 A 11/1993 Becker et al.
5,355,819 A 10/1994 Hsia et al.
5,360,656 A 11/1994 Rexfelt et al.
5,391,424 A 2/1995 Kolzer
5,413,065 A 5/1995 Spragg et al.
5,421,128 A 6/1995 Sharpless et al.
5,431,970 A 7/1995 Broun et al.
5,482,763 A 1/1996 Shaffer
5,488,921 A 2/1996 Spragg
5,503,291 A 4/1996 Craig
5,505,557 A 4/1996 Bradley
5,544,612 A 8/1996 Eymard
5,657,714 A 8/1997 Hsia et al.
5,691,390 A 11/1997 Harrison et al.
5,713,399 A 2/1998 Collette et al.
5,735,083 A 4/1998 Brown et al.
5,780,144 A 7/1998 Bradley
5,790,304 A 8/1998 Sanders et al.
5,865,045 A 2/1999 Wagner et al.
5,902,070 A 5/1999 Bradley
5,921,421 A 7/1999 Fuquan
5,951,345 A 9/1999 Perratone et al.
6,003,565 A 12/1999 Whittier, II et al.
6,047,655 A 4/2000 Cran
6,056,438 A 5/2000 Bradley
6,086,968 A 7/2000 Horovitz
6,101,964 A 8/2000 Lesesne
6,199,676 B1 * 3/2001 Targiroff ..... 193/25 B

FOREIGN PATENT DOCUMENTS

EP 0 134 706 A 3/1985
EP 0 710 736 A1 11/1994
EP 0 687 625 12/1995
EP 0 862 870 A 9/1998
EP 832 032 4/1999
FR 2 325 837 4/1977
FR 2595621 9/1987
GB 824 984 A 12/1959
GB 826 301 A 12/1959
GB 933 889 A 8/1963
GB 1 079 766 8/1967
GB 1117552 6/1968
GB 1117553 6/1968
JP 60 219243 A 11/1985
WO WO 97/14622 A 4/1997
WO WO 97/49541 12/1997
WO WO 98/01359 A 1/1998

* cited by examiner

SPIRAL FORMED FLEXIBLE FLUID CONTAINMENT VESSEL

CROSS-REFERENCE TO RELATED APPLICATIONS

This application is a continuation-in-part of U.S. Ser. No. 09/832,739 filed Apr. 11, 2001 entitled "Flexible Fluid Containment Vessel" the disclosure of which is incorporated by reference herein.

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and the method of making the same.

BACKGROUND OF THE INVENTION

The use of flexible containers for the containment and transportation of cargo, particularly fluid or liquid cargo, is well known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, since a seamed structure is an alternative to a simple woven fabric and would have different advantages thereto, particularly in the fabrication thereof, it would be desirable if one could create a seamed tube that was not prone to failure at the seams.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips. The fabric strip of yarn material, preferably being a flat-woven fabric strip, has longitudinal threads which in the final base fabric make an angle in what would be the machine direction of a press felt.

During the manufacture of the base fabric, the fabric strip of yarn material is wound or placed spirally, preferably over at least two rolls having parallel axes. Thus, the length of fabric will be determined by the length of each spiral turn of the fabric strip of yarn material and its width determined by the number of spiral turns.

The number of spiral turns over the total width of the base fabric may vary. The adjoining portions of the longitudinal edges of the spirally-wound fabric strip are so arranged that the joints or transitions between the spiral turns can be joined in a number of ways.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of non-woven material or of non-woven material with melting fibers. The edge joint can also be obtained by providing the fabric strip of yarn material along its two longitudinal edges with seam loops of known type, which can be joined by means of one or more seam threads. Such seam loops may for instance be formed directly of the weft threads, if the fabric strip is flat-woven.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

It should be noted that U.S. Pat. No. 5,902,070 entitled "Geotextile Container and Method of Producing Same" issued May 11, 1999 and assigned to Bradley Industrial Textiles, Inc. does disclose a helically formed container. Such a container is, however, intended to contain fill and to be stationary rather than a transport container.

Returning to the particular application to which the present invention is directed, other problems face the use of large transport containers. In this regard, when partially or completely filled flexible barges or transport containers are towed through salt water, problems as to instability are known to occur. This instability is described as a flexural oscillation of the container and is directly related to the flexibility of the partially or completely filled transport container. This flexural oscillation is also known as snaking. Long flexible containers having tapered ends and a relatively constant circumference over most of their length are known for problems with snaking. Snaking is described in U.S. Pat. No. 3,056,373, observing that flexible barges having tapered ends build up to damaging oscillations capable of seriously rupturing or, in extreme cases, destroying the barge, when towed at a speed above a certain critical speed. Oscillations of this nature were thought to be set up by forces acting laterally on the barge towards its stern. A solution suggested was to provide a device for creating breakaway in the flow lines of the water passing along the surface of the barge and causing turbulence in the water around the stern. It is said that such turbulence would remove or decrease the forces causing snaking, because snaking depends on a smooth flow of water to cause sideways movement of the barge.

Other solutions have been proposed for snaking by, for example, U.S. Pat. Nos. 2,998,973; 3,001,501; and 3,056,373. These solutions include drogues, keels and deflector rings, among others.

Another solution for snaking is to construct the container with a shape that provides for stability when towing. A company known as Nordic Water Supply located in Norway has utilized this solution. Flexible transport containers utilized by this company have a shape that can be described as an elongated hexagon. This elongated hexagon shape has been shown to provide for satisfactory stable towing when transporting fresh water on the open sea. However, such containers have size limitations due to the magnitude of the forces placed thereon. In this regard, the relationship of towing force, towing speed and fuel consumption for a container of given shape and size comes into play. The operator of a tugboat pulling a flexible transport container desires to tow the container at a speed that minimizes the cost to transport the cargo. While high towing speeds are attractive in terms of minimizing the towing time, high towing speeds result in high towing forces and high fuel consumption. High towing forces require that the material used in the construction of the container be increased in strength to handle the high loads. Increasing the strength typically is addressed by using thicker container material. This, however, results in an increase in the container weight and a decrease in the flexibility of the material. This, in turn, results in an increase in the difficulty in handling the flexible transport container, as the container is less flexible for winding and heavier to carry.

Moreover, fuel consumption rises rapidly with increased towing speed. For a particular container, there is a combination of towing speed and fuel consumption that leads to a minimum cost for transportation of the cargo. Moreover, high towing speeds can also exacerbate problems with snaking.

In the situation of the elongated hexagon shaped flexible transport containers used in the transport of fresh water in the open sea, it has been found, for a container having a capacity of 20,000 cubic meters, to have an acceptable combination of towing force (about 8 to 9 metric tons), towing speed (about 4.5 knots) and fuel consumption. Elongated hexagon shaped containers having a capacity of 30,000 cubic meters are operated at a lower towing speed, higher towing force and higher fuel consumption than a 20,000 cubic meter cylindrical container. This is primarily due to the fact that the width and depth of the larger elongated hexagon must displace more salt water when pulled through open sea. Further increases in container capacity are desirable in order to achieve an economy of scale for the transport operation. However, further increases in the capacity of elongated hexagon shaped containers will result in lower towing speeds and increased fuel consumption.

The aforenoted concerning snaking, container capacity, towing force, towing speed and fuel consumption defines a need for an improved flexible transport container design. There exists a need for an improved design that achieves a combination of stable towing (no snaking), high FFCV capacity, high towing speed, low towing force and low fuel consumption relative to existing designs.

In addition, to increase the volume of cargo being towed, it has been suggested to tow a number of flexible containers together. Such arrangements can be found in U.S. Pat. Nos. 5,657,714; 5,355,819; and 3,018,748 where a plurality of containers are towed in line one after another. So as to increase stability of the containers, EPO 832 032 B1 discloses towing multiple containers in a pattern side by side.

However, in towing flexible containers side by side, lateral forces caused by ocean wave motion creates instability which results in one container pushing into the other and rolling end over end. Such movements have a damaging effect on the containers and also effect the speed of travel.

Furthermore, while as aforenoted, a seamless flexible container is desirable and has been mentioned in the prior art, the means for manufacturing such a structure has its difficulties. Heretofore, as noted, large flexible containers were typically made in smaller sections which were sewn or bonded together. These sections had to be water impermeable. Typically such sections, if not made of an impermeable material, could readily be provided with such a coating prior to being installed. The coating could be applied by conventional means such as spraying or dip coating.

Accordingly, there exists a need for a FFCV for transporting large volumes of fluid which overcomes the aforenoted problems attendant to such a structure and the environment in which it is to operate.

SUMMARY OF THE INVENTION

It is therefore a principal object of the invention to provide for a relatively large spirally formed fabric FFCV for the transportation of cargo, including, particularly, fresh water, having a density less than that of salt water.

It is a further object of the invention to provide for such an FFCV which has means of inhibiting the undesired snaking thereof during towing.

It is a further object of the invention to provide means for allowing the transportation of a plurality of such FFCVs.

A further object of the invention is to provide for a means for reinforcing of such an FFCV so as to effectively distribute the load thereon and inhibit rupture.

A yet further object is to provide for a means of rendering the tube used in the FFCV impermeable.

These and other objects and advantages will be realized by the present invention. In this regard the present invention envisions the use of a spirally formed tube to create the FFCV, having a length of 300' or more and a diameter of 40' or more. Such a large structure can be fabricated in a manner set forth in U.S. Pat. No. 5,360,656 and on machines that make papermaker's clothing such as those owned and operated by the assignee hereof. The ends of the tube, sometimes referred to as the nose and tail, or bow and stern, are sealed by any number of means, including being folded over and bonded and/or stitched with an appropriate tow bar attached at the nose. Examples of end portions in the prior art can be found in U.S. Pat. Nos. 2,997,973; 3,018,748; 3,056,373; 3,067,712; and 3,150,627. An opening or openings are provided for filling and emptying the cargo such as those disclosed in U.S. Pat. Nos. 3,067,712 and 3,224,403.

In addition, through the use of the spiral strip method, the bow or stern or both can be tapered in, for example, a cone shape or other shape suitable for the purpose.

In order to reduce the snaking effect on such a long structure, a plurality of longitudinal stiffening beams are provided along its length. These stiffening beams are intended to be pressurized with air or other medium. The beams may be formed as part of the tube or woven separately and maintained in sleeves which may be part of the FFCV. They may also be braided in a manner as set forth in U.S. Pat. Nos. 5,421,128 and 5,735,083 or in an article entitled "3-D Braided Composites-Design and Applications" by D. Brookstein, $6^{th}$ European Conference on Composite Materials, September 1995. They can also be knit or laid up. The tube is preferably the spiral method heretofore described. Attaching or fixing such beams by sewing or other means to the tube is possible, however, unitized construction is preferred due to the ease of manufacturing and its greater strength.

Stiffening or reinforcement beams of similar construction as noted above may also be provided at spaced distances about the circumference of the tube.

The beams also provide buoyancy to the FFCV as the cargo is unloaded to keep it afloat, since the empty FFCV would normally be heavier than salt water. Valves may be provided which allow pressurization and depressurization as the FFCV is wound up for storage.

In the situation where more than one FFCV is being towed, it is envisioned that one way is that they be towed side by side. To increase stability and avoid "roll over" a plurality of beam separators, preferably containing pressurized air or other medium, would be used to couple adjacent FFCVs together along their length. The beam separators can be affixed to the side walls of the FFCV by way of pin seam connectors or any other means suitable for purpose.

Another way would be by constructing a series of FFCVs interconnected by a flat spiral formed portion.

The present invention also discloses methods rendering the tube impervious. The fabric strip can be coated on the inside, outside, or both with an impervious material. When formed into the tube, the seams may be further coated.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENTS

Figure 2:
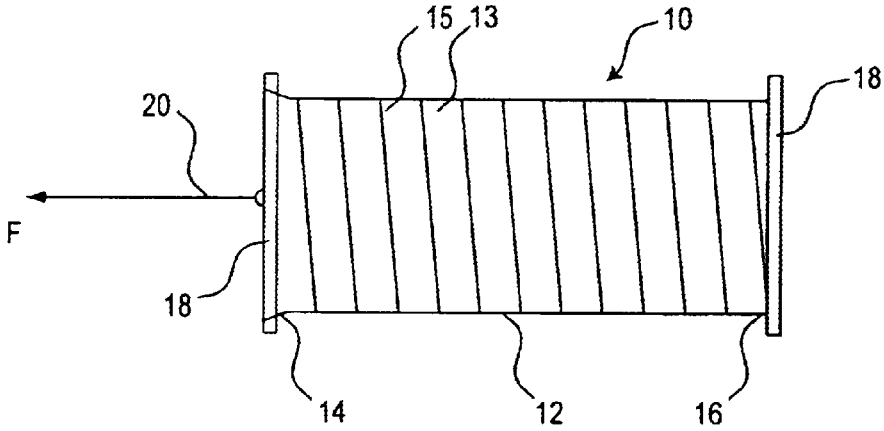
FIG. 2 is a somewhat general perspective view of a FFCV which is cylindrical having a flattened bow or nose incorporating the teachings of the present invention.

The proposed FFCV 10 is intended to be constructed of an impermeable textile tube. The tube's configuration may vary. For example, as shown in FIG. 2, it would comprise a tube 12 having a substantially uniform diameter (perimeter) and sealed on each end 14 and 16. The respective ends 14 and 16 may be closed, pinched, and sealed in any number of ways, as will be discussed. The resulting impermeable structure will also be flexible enough to be folded or wound up for transportation and storage.

Before discussing more particularly the FFCV design of the present invention, it is important to take into consideration certain design factors. The even distribution of the towing load is crucial to the life and performance of the FFCV. During the towing process there are two types of drag forces operating on the FFCV, viscous drag and form drag forces. The total force, the towing load, is the sum of the viscous and form drag forces. When a stationary filled FFCV is initially moved, there is an inertial force experienced during the acceleration of the FFCV to constant speed. The inertial force can be quite large in contrast with the total drag force due to the large amount of mass being set in motion.

It has been shown that the drag force is primarily determined by the largest cross-section of the FFCV profile, or the point of largest diameter. Once at constant speed the inertial tow force is zero and the total towing load is the total drag force.

As part of this, and in addition thereto, it has been determined that to increase the volume of the FFCV, it is more efficient to increase its length than it is to increase both its length and width. For example, a towing force as a function of towing speed, has been developed for a cylindrically shaped transport bag having a spherically shaped bow and stern. It assumes that the FFCV is fully submersed in water. While this assumption may not be correct for a cargo that has a density less than salt water, it provides a means to estimate relative effects of the FFCV design on towing requirements. This model estimates the total towing force by calculating and adding together two components of drag for a given speed. The two components of drag are viscous drag and form drag. The formulae for the drag components are shown below.

$$\text{Viscous Drag (tons)}=(0.25*(A4+D4)*(B4+(3.142*C4))*E4\hat{}1.63/8896$$

$$\text{Form Drag (tons)}=(((B4-(3.14*C4/2))*C4/2)\hat{}1.87)*E4\hat{}1.33*1.133/8896$$

$$\text{Total towing force (tons)}=\text{Viscous drag (tons)}+\text{Form drag (tons)}$$

where A4 is the overall length in meters, D4 is the total length of the bow and stern sections in meters, B4 is the perimeter of the bag in meters, C4 is the draught in meters and E4 is the speed in knots.

The towing force for a series of FFCV designs can now be determined. For example, assume that the FFCV has an overall length of 160 meters, a total length of 10 meters for the bow and stern sections, a perimeter of 35 meters, a speed of 4 knots and the bag being filled 50%. The draught in meters is calculated assuming that the cross sectional shape of the partially filled FFCV has a racetrack shape. This shape assumes that the cross section looks like two half circles joined to a rectangular center section. The draught for this FFCV is calculated to be 3.26 meters. The formula for the draught is shown below.

$$\text{Draught (meters)}=B4/3.14*(1-((1-J4)\hat{}0.5))$$

where J4 is the fraction full for the FFCV (50% in this case).

For this FFCV the total drag is 3.23 tons. The form drag is 1.15 tons and the viscous drag is 2.07 tons. If the cargo was fresh water, this FFCV would carry 7481 tons at 50% full.

If one desires a FFCV that can carry about 60,000 tons of water at 50% full, the FFCV capacity can be increased in at least two ways. One way is to scale up the overall length, total length of the bow and stern sections and perimeter by an equal factor. If these FFCV dimensions are increased by a factor of 2, the FFCV capacity at 50% full is 59,846 tons. The total towing force increases from 3.23 tons for the prior FFCV to 23.72 tons for this FFCV. This is an increase of 634%. The form drag is 15.43 tons (an increase of 1241%) and the viscous drag is 8.29 tons (an increase of 300%). Most of the increase in towing force comes from an increase in the form drag which reflects the fact that this design requires more salt water to be displaced in order for the FFCV to move through the salt water.

An alternative means to increase the capacity to 60,000 tons is to lengthen the FFCV while keeping the perimeter, bow and stern dimensions the same. When the overall length is increased to 1233.6 meters the capacity at 50% fill is 59,836 tons. At a speed of 4 knots the total drag force is 16.31 tons or 69% of the second FFCV described above. The form drag is 1.15 tons (same as the first FFCV) and the viscous drag is 15.15 tons (an increase of 631% over the first FFCV).

This alternative design (an elongated FFCV of 1233.6 meters) clearly has an advantage in terms of increasing capacity while minimizing any increase in towing force. The elongated design will also realize much greater fuel economy for the towing vessel relative to the first scaled up design of the same capacity.

With the preferred manner of increasing the volume of the FFCV having been determined, we turn now to the general construction of the tube 12 which will make up the FFCV. The present invention envisions forming the tube 12 in a manner as disclosed in U.S. Pat. No. 5,360,656 entitled "Press Felt and Method of Manufacturing It" which issued Nov. 1, 1994, the disclosure of which is incorporated herein by reference.

This reference discloses a base fabric of a press felt that is fabricated from spirally-wound fabric strips.

Since the tube 12 is essentially an elongated cylindrical fabric, the method of manufacturing described therein can be utilized to create a tube 12 for the FFCV 10. In this regard, during the manufacture of the tube 12, the fabric strip 13 of yarn material is wound or placed spirally, preferably over at least two rolls having parallel axes. The length of fabric will be determined by the length of each spiral turn of the fabric strip of yarn material and its width determined by the number of spiral turns.

The number of spiral turns over the total width of the base fabric may vary. The adjoining portions of the longitudinal edges of the spirally-wound fabric strip are so arranged that the joints or transitions between the spiral turns can be joined in a number of ways. An edge joint 15 can be achieved, e.g. by sewing, melting and welding (for instance, ultrasonic welding as set forth in U.S. Pat. No. 5,713,399 as aforementioned), of non-woven material or of non-woven material with meltable fibers. The edge joint can also be obtained by providing the fabric strip of yarn material along its two longitudinal edges with seam loops of known type, which can be joined by means of one or more seam threads. Such seam loops may, for instance, be formed directly of the weft threads, if the fabric strip is flat-woven. The fabric making up the fabric strip 13 may be that of any material suitable for purpose. The fabric strips 13 may also be reinforced with reinforcing yarns, as desired, in a manner readily apparent to the skilled artisan.

In addition, since the intended use of the tube is that of a container rather than a press fabric (where a smooth transition between fabric strips is desired), this is not a particular concern and different joining methods of the seam between adjacent fabric strips (particularly, overlapping and sewing or bonding, etc.) is possible so as to increase seam strengths, since, as aforesaid, this is a common point of failure. In this regard, stronger seams can be made by overlapping the fabric edges and bonding the two fabrics together by ultrasonic or thermal bonding. The overlap may need to be on the order of 25 mm to 50 mm or more. The objective of the overlap and bonded seam is to achieve a seam strength that is at least equal to or near the strength of the fabric strips 13.

Another means to increase seam strength, in addition to bonding, is to staple the fabrics together using non-corrosive staples such as stainless steel staples. These staples may need to be 25 mm in width and may need to be applied as frequently as every 25 mm in the length of the spirally joined seam. The objective is to achieve high seam strength relative to the fabric strength, while also using materials that will not corrode or fail in the life of the water transport bag.

Note, this method allows for the fabric strips 13 to be pre-coated on one or both sides so as to be impermeable to salt water and salt water ions, prior to being spirally-wound and joined. This eliminates the need to coat a large woven structure. If necessary, only the seam between adjacent fabric strips 13 may require coating. In such a case, this may be implemented during the spiraling process.

Of course, if so desired, the tubular structure may be made from uncoated fabric and then coating the entire structure in a manner as set forth in the aforesaid patent application.

Sealing at the end of the tube 12 can be in a manner as described in the aforesaid patent application, some examples of which are hereinafter described.

Figure 8A:
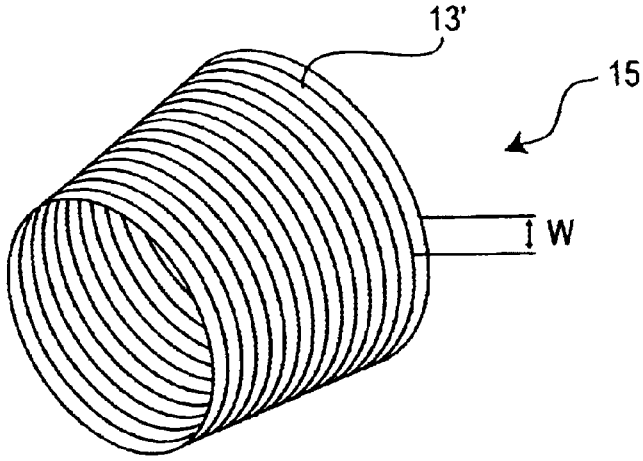
FIG. 8A is a perspective view of a spirally formed portion of bow or stern incorporating the teachings of the present invention.
Figure 8B:
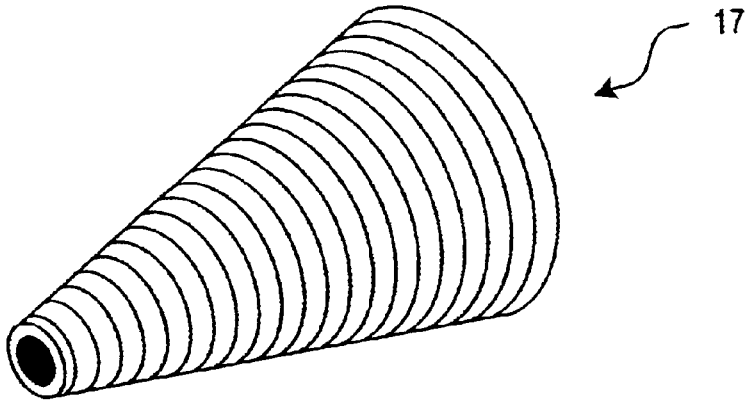
FIG. 8B is a perspective view of a completed spirally formed bow or stern incorporating the teachings of the present invention.
Figure 8:
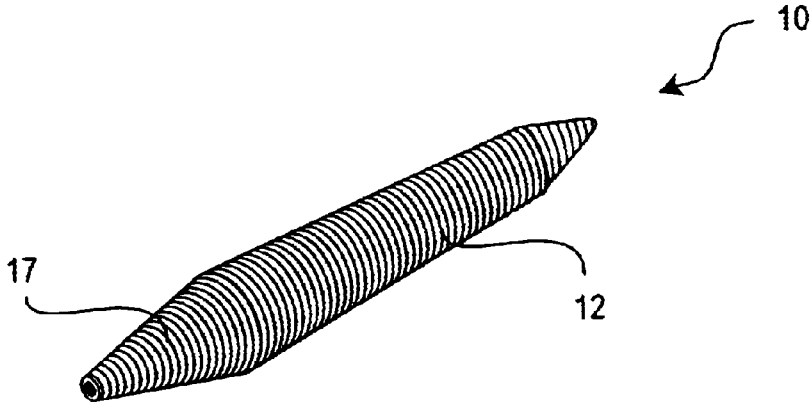
FIG. 8 is a perspective view of a spirally formed FFCV having a conically formed bow and stern incorporating the teachings of the present invention.

Note, however, that this spiral method has an additional attendant advantage, particularly in the formation of the end portions, bow or stern. In this regard reference is made to FIGS. 8A and 8B.

In these figures there is shown a method for spiral forming the end portions into a cone 17 using fabric strips 13 of material. In this regard, the method envisions the use of creating a fabric strip 13 with difference in length across its width W. In a gradient over the width, one edge is, for example, 1–10% wider than the other. The can be done, for example, by weaving a normal weave, and having a gradient heat set over the width. One edge will be longer/shorter than the other upon heatsetting.

Alternatively, the fabric strip could be woven with a creel warp or bobbins with separate breaks, using a take up roll in a cone shape. This will give a weave coming out the desired gradient.

With one edge of the weave 1–10% longer than the other, over a width gradient, this gives the possibility to connect edge to edge or by overlap and get the cone 17 growing out of it. The cone 17 dimensions can be altered by the degree of length difference from edge to edge in the weave. For example, with a cone diameter of 2.5 meters (m) in the narrow part and a diameter of 24 m in the widest part, the length of the cone 17 will approximately be the following with a 1 m wide fabric strip.

| Length difference % (edge to edge) | Length of the cone (m) |
|---|---|
| 10 | 24 |
| 5 | 46 |
| 3 | 76 |
| 2 | 113 |

This method allows for the cone 17 to be tailor made to the desired geometry. The tube 12 can be made separate, or integral to the cone 17, or separately and then attached in a manner as described in the aforesaid patent application. If integrally formed, gradient heatsetting may be used for the front cone weaving with a constant temperature heatsetting for the tube 12 and at the other end, a reversed gradient heatsetting for the other cone.

The spiral method can also be used to form a cone by applying different tensions to the two pieces of fabric that are being joined. By applying a higher tension to the fabric being fed into the tube making operation, the joined fabric will form a cone. Another method is to change the amount of overlap and angle of the fabric being fed into the tube making machine. This method calls for the fabrics to be unparallel during joining. The method will also form a cone.

Figure 9:
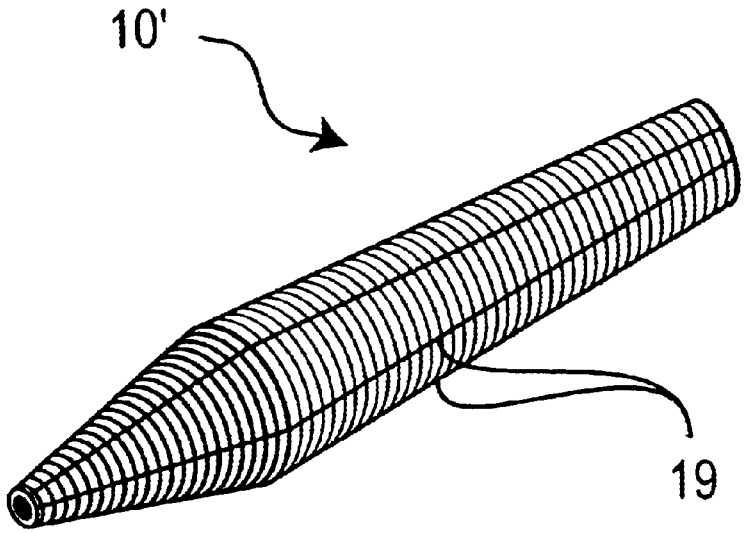
FIG. 9 is a perspective view of a spirally formed FFCV having reinforcement pockets formed thereon incorporating the teachings of the present invention.

Turning now briefly to FIG. 9, there is shown a FFCV 10' which is spirally formed having conical ends 17 formed in the manner aforesaid. The FFCV 10' includes longitudinal pockets 19 in which reinforcing members such as ropes, braid or wire may be placed and, for example, coupled to a suitable end cap or tow bar. Similar circumferential pockets could also be provided. These pockets 19 are positioned about the circumference of the FFCV 10' at desired locations. The pockets 19 may be formed by folding a portion of the fabric and the stitching along the fold. Other means of creating the pocket, in addition to sewing, will be readily apparent to the skilled artisan. By the foregoing arrangement, the load on the FFCV is principally on the reinforcing elements with the load on the fabric being greatly reduced, thus allowing for, among other things, a lighter weight fabric. Also, the reinforcing elements will act as rip stops so as to contain tears or damage to the fabric.

Once the FFCV 10' is formed, the ends may be sealed in a manner as described herein including a towing cap or other means suitable for purpose.

Sealing the ends is required not only to enable the structure to contain water or some other cargo, but also to provide a means for towing the FFCV.

In the situation where just the tube 12 is spirally formed without the cone portions, sealing can be accomplished in many ways. The sealed end can be formed by collapsing the end 14 of the tube 12 and folded over one or more times as shown in FIG. 2. One end 14 of the tube 12 can be sealed such that the plane of the sealed surface is, either in the same plane as the seal surface at the other end 16 of the tube, or alternatively, end 14 can be orthogonal to the plane formed by the seal surface at the other end 16 of the tube creating a bow which is perpendicular to the surface of the water, similar to that of a ship. For sealing, the ends 14 and 16 of the tube are collapsed such that a sealing length of a few feet results. Sealing is facilitated by gluing or sealing the inner surfaces of the flattened tube end with a reactive material or adhesive. In addition, the flattened ends 14 and 16 of the tube can be clamped and reinforced with metal or composite bars 18 that are bolted or secured through the composite structure. These metal or composite bars 18 can provide a means to attach a towing mechanism 20 from the tugboat that tows the FFCV.

The end 14 (collapsed and folded) will be sealed with a reactive polymer sealant or adhesive. The sealed end can also be reinforced with metal or composite bars to secure the sealed end and can be provided with a means for attaching a towing device.

Figure 1:
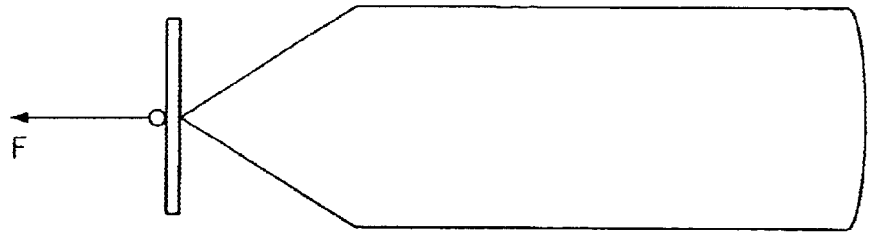
FIG. 1 PRIOR ART
FIG. 1 is a somewhat general perspective view of a prior art FFCV which is cylindrical having a pointed bow or nose.
Figure 2A:
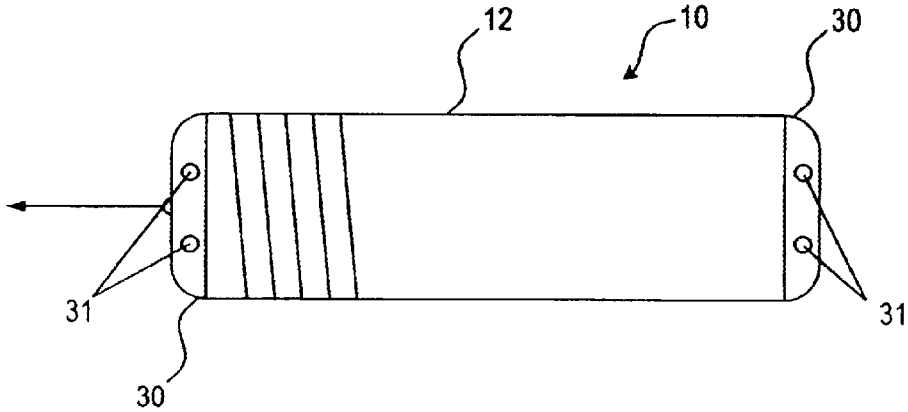
FIG. 2A is a somewhat general perspective view of a FFCV having blunt end caps on its bow and stern incorporating the teachings of the present invention.

Another means for sealing the ends involves attaching metal or composite end caps 30 as shown in FIG. 2A. In this embodiment, the size of the caps will be determined by the perimeter of the tube. The perimeter of the end cap 30 will be designed to match the perimeter of the inside of the tube 12 and will be sealed therewith by gluing, bolting or any other means suitable for purpose. The end cap 30 will serve as the sealing, filling/emptying via ports 31, and towing attachment means. The FFCV is not tapered, rather it has a more "blunt" end with the substantially uniform perimeter which distributes the force over the largest perimeter, which is the same all along the length, instead of concentrating the forces on the smaller diameter neck area of prior art FFCV (see FIG. 1). By attaching a tow cap that matches the perimeter it ensures a more equal distribution of forces, particularly start up towing forces, over the entire FFCV structure.

Figure 2B:
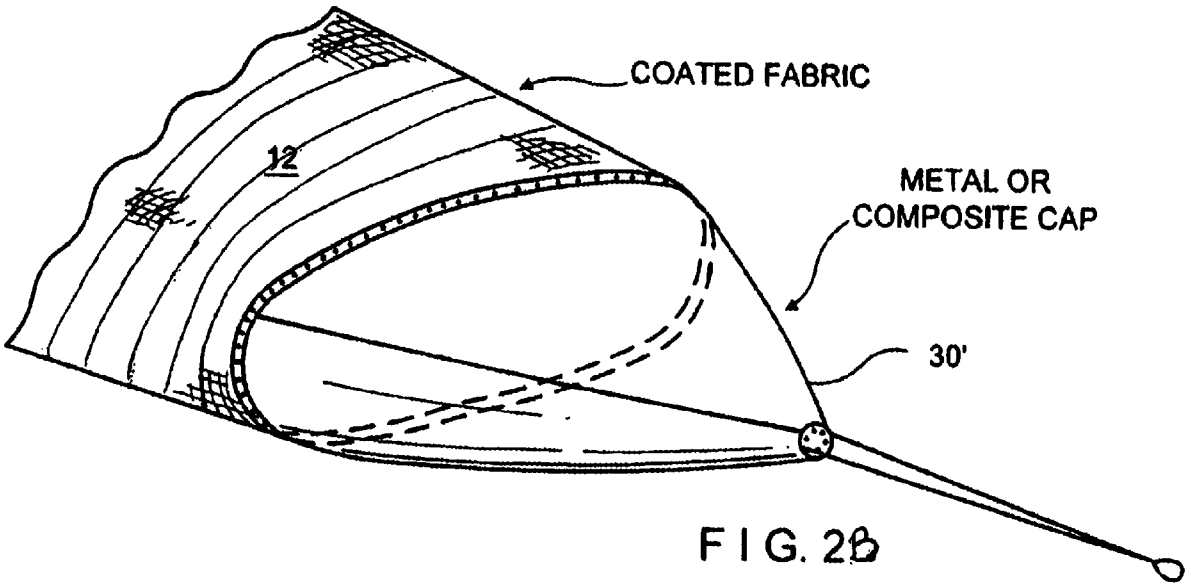
FIGS. 2B and 2C show an alternative end cap arrangement to that shown in FIG. 2A incorporating the teachings of the present invention.
Figure 2C:
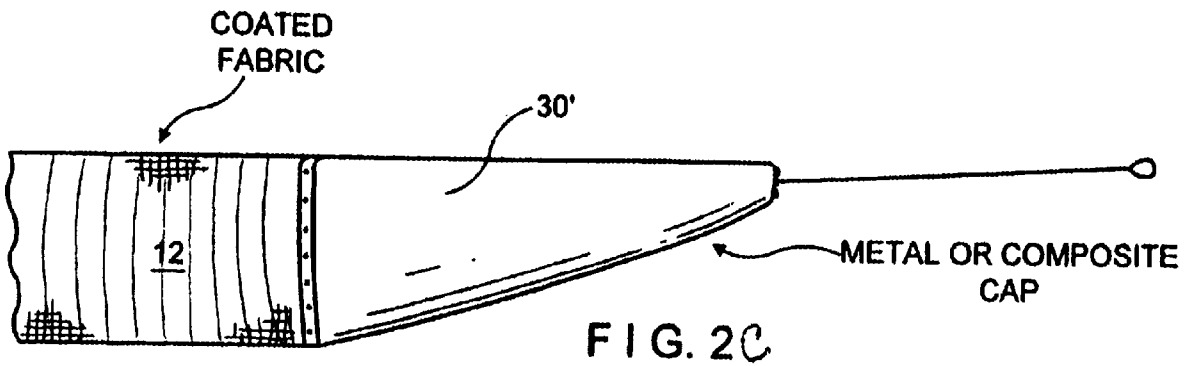

An alternative design of an end cap is shown in FIGS. 2B and 2C. The end cap 30' shown is also made of metal or composite material and is glued, bolted or otherwise sealed to tube 12. As can be seen, while being tapered, the rear portion of cap 30' has a perimeter that matches the inside perimeter of the tube 12 which provides for even distribution of force thereon.

The collapsed approach, the collapsed and folded configuration for sealing, or the end cap approach can be designed to distribute, rather than concentrate, the towing forces over the entire FFCV and will enable improved operation thereof.

Having already considered towing forces to determine the shape which is more efficient i.e. longer is better than wider, and the means for sealing the ends of the tube, we turn now to a discussion of the forces on the FFCV itself in material selection and construction.

The forces that may occur in a FFCV can be understood from two perspectives. In one perspective, the drag forces for a FFCV traveling through water over a range of speeds can be estimated. These forces can be distributed evenly throughout the FFCV and it is desirable that the forces be distributed as evenly as possible. Another perspective is that the FFCV is made from a specific material having a given thickness. For a specific material, the ultimate load and elongation properties are known and one can assume that this material will not be allowed to exceed a specific percentage of the ultimate load. For example, assume that the FFCV material has a basis weight of 1000 grams per square meter and that half the basis weight is attributed to the textile material (uncoated) and half to the matrix or coating material with 70% of the fiber oriented in the lengthwise direction of the FFCV. If the fiber is, for example, nylon 6 or nylon 6.6 having a density of 1.14 grams per cubic centimeter, one can calculate that the lengthwise oriented nylon comprises about 300 square millimeters of the FFCV material over a width of 1 meter. Three hundred (300) square millimeters is equal to about 0.47 square inches. If one assumes that the nylon reinforcement has an ultimate breaking strength of 80,000 pounds per square inch, a one meter wide piece of this FFCV material will break when the load reaches 37,600 lbs. This is equivalent to 11,500 pounds per lineal foot. For a FFCV having a diameter of 42 ft. the circumference is 132 ft. The theoretical breaking load for this FFCV would be 1,518,000 lbs. Assuming that one will not exceed 33% of the ultimate breaking strength of the nylon reinforcement, then the maximum allowable load for the FFCV would be about 500,000 lbs or about 4,000 pounds per lineal foot (333 pounds per lineal inch). Accordingly, load requirement can be determined and should be factored into material selection and construction techniques.

Also, the FFCV will experience cycling between no load and high load. Accordingly, the material's recovery properties in a cyclical load environment should also be considered in any selection of material. The materials must also withstand exposure to sunlight, salt water, salt water temperatures, marine life and the cargo that is being shipped. The materials of construction must also prevent contamination of the cargo by the salt water. Contamination would occur, if salt water were forced into the cargo or if the salt ions were to diffuse into the cargo.

With the foregoing in mind, the present invention as aforenoted envisions FFCVs being constructed from fabric strips of textiles (coated or uncoated) (i.e. coated or uncoated woven fabric, coated or uncoated knit fabric, coated or uncoated non-woven fabric, or coated or uncoated netting). As to coated textiles, they have two primary components. These components are the fiber reinforcement and the polymeric coating. A variety of fiber reinforcements and polymeric coating materials are suitable for FFCVs. Such materials must be capable of handling the mechanical loads and various types of extensions which will be experienced by the FFCV.

The present invention envisions a breaking tensile load that the FFCV material should be designed to handle in the range from about 1100 pounds per inch of fabric width to 2300 pounds per inch of fabric width. In addition, the coating must be capable of being folded or flexed repeatedly as the FFCV material is frequently wound up on a reel.

Suitable polymeric coating materials include polyvinyl chloride, polyurethanes, synthetic and natural rubbers, polyureas, polyolefins, silicone polymers and acrylic polymers. These polymers can be thermoplastic or thermoset in nature. Thermoset polymeric coatings may be cured via heat, room temperature curable or UV curable. The polymeric coatings may include plasticizers and stabilizers that either add flexibility or durability to the coating. The preferred coating materials are plasticized polyvinyl chloride, polyurethanes and polyureas. These materials have good barrier properties and are both flexible and durable.

Suitable fiber reinforcement materials are nylons (as a general class), polyesters (as a general class), polyaramids (such as Kevlar®, Twaron or Technora), polyolefins (such as Dyneema and Spectra) and polybenzoxazole (PBO).

Within a class of material, high strength fibers minimize the weight of the fabric required to meet the design requirement for the FFCV. The preferred fiber reinforcement materials are high strength nylons, high strength polyaramids and high strength polyolefins. PBO is desirable for it's high strength, but undesirable due to its relative high cost. High strength polyolefins are desirable for their high strength, but difficult to bond effectively with coating materials.

For woven fabric strips, the fiber reinforcement can be formed into a variety of weave constructions for the fabric strips. These weave constructions vary from a plain weave (1×1) to basket weaves and twill weaves. Basket weaves such as a 2×2, 3×3, 4×4, 5×5, 6×6, 2×1, 3×1, 4×1, 5×1 and 6×1 are suitable. Twill weaves such as 2×2, 3×3, 4×4, 5×5, 6×6, 2×1, 3×1, 4×1, 5×1and 6×1 are suitable. Additionally, satin weaves such as 2×1, 3×1, 4×1, 5×1 and 6×1 can be employed. While a single layer weave has been discussed, as will be apparent to one skilled in the art, multi-layer weaves might also be desirable, depending upon the circumstances.

The yarn size or denier in yarn count will vary depending on the strength of the material selected. The larger the yarn diameter the fewer threads per inch will be required to achieve the strength requirement. Conversely, the smaller the yarn diameter the more threads per inch will be required to maintain the same strength. Various levels of twist in the yarn can be used depending on the surface desired. Yarn twist can vary from as little as zero twist to as high as 20 turns per inch and higher. In addition, yarn shapes may vary. Depending upon the circumstances involved, round, elliptical, flattened or other shapes suitable for the purpose may be utilized.

Accordingly, with all of the foregoing in mind, the appropriate fiber and weave may be selected for the fabric strips along with the coating to be used.

Figure 3:
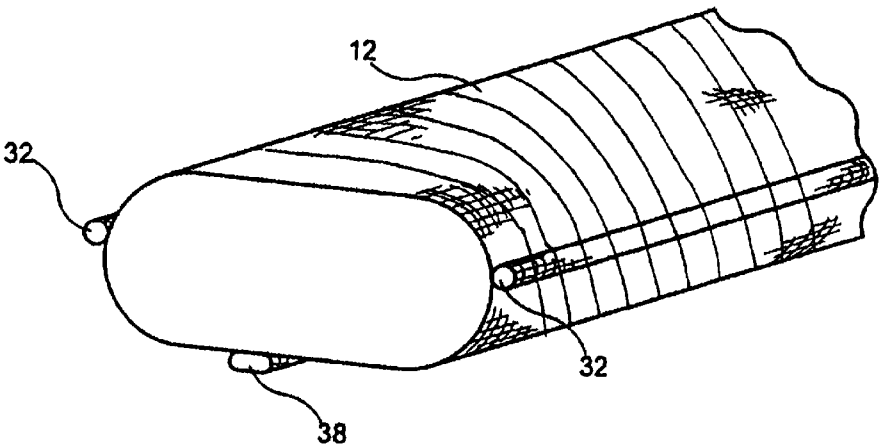
FIG. 3 is a sectional view of a FFCV having longitudinal stiffening beams incorporating the teachings of the present invention.

Returning now, however, to the structure of the FFCV 10 itself, while it has been determined that a long structure is more efficiently towed at higher speeds (greater than the present 4.5 knots), snaking in such structures is, however, a problem. To reduce the occurrence of snaking, the present invention provides for an FFCV 10 constructed with one or more lengthwise or longitudinal beams 32 that provide stiffening along the length of the tube 12 as shown in FIG. 3. In this way a form of structural lengthwise rigidity is added to a FFCV 10. The beams 32 may be airtight tubular structures made from coated fabric. When the beam 32 is inflated with pressurized gas or air, the beam 32 becomes rigid and is capable of supporting an applied load. The beam 32 can also be inflated and pressurized with a liquid such as water or other medium to achieve the desired rigidity. The beams 32 can be made to be straight or curved depending upon the shape desired for the application and the load that will be supported.

The beams 32 can be attached to the FFCV 10 or, they can be constructed as an integral part of the FFCV in a manner as previously described with regard to reinforcing pockets 19. In FIG. 3, two beams 32, oppositely positioned, are shown. The beams 32 can extend for the entire length of the FFCV 10 or they can extend for just a short portion of the FFCV 10. The length and location of the beam 32 is dictated by the need to stabilize the FFCV 10 against snaking. The beams 32 can be in one piece or in multiple pieces 34 that extend along the FFCV 10 (see FIG. 4).

Preferably the beam 32 is made as an integral part of the FFCV 10. In this way the beam 32 is less likely to be separated from the FFCV 10.

Figure 3A:
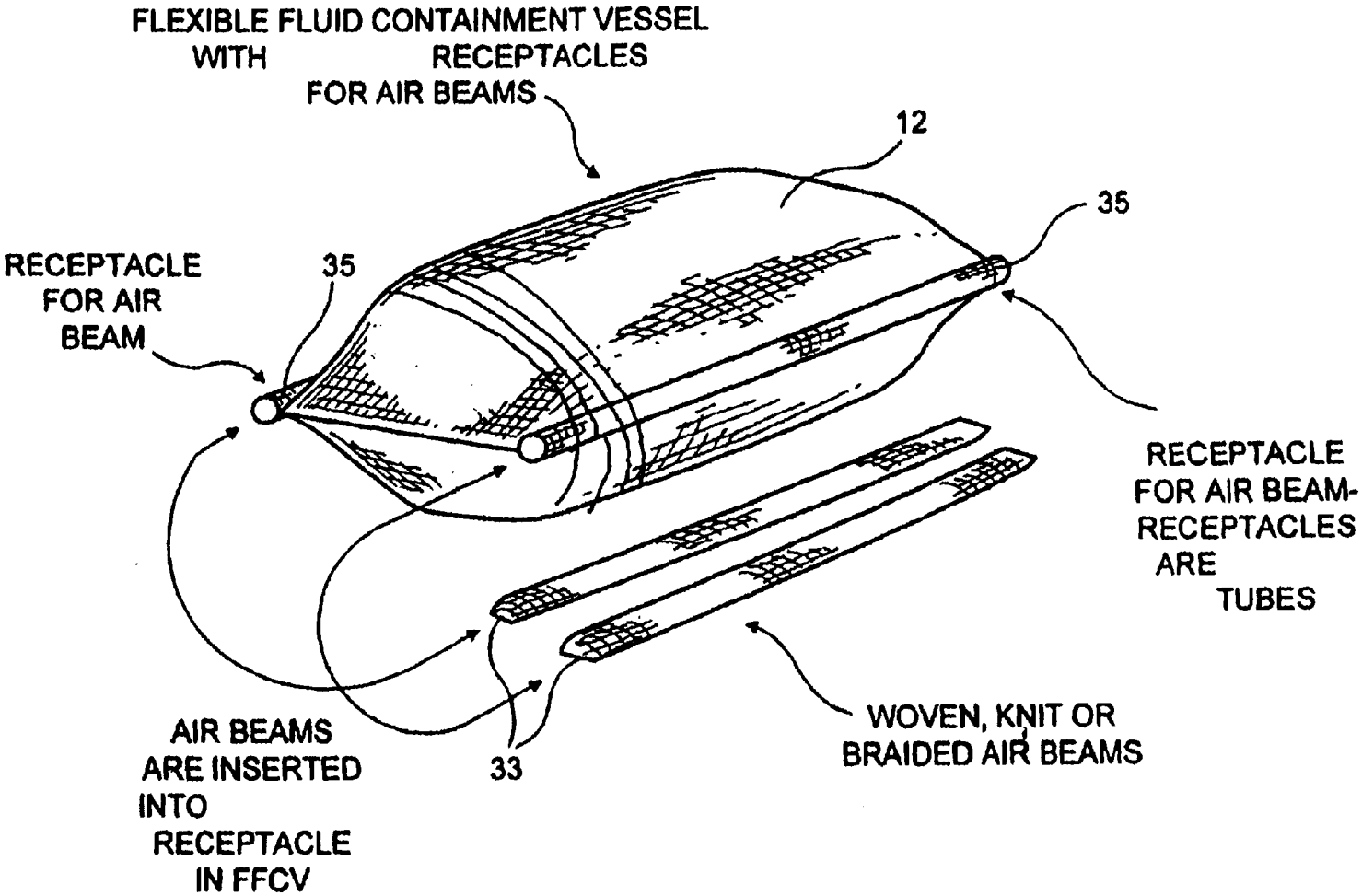
FIG. 3A is a somewhat general perspective view of a FFCV having longitudinal stiffening beams (shown detached) which are inserted in sleeves along the FFCV incorporating the teachings of the present invention.

It might also, however, be desirable to make the inflatable stiffening beams 33 as separate units and, as shown in FIG. 3A. The tubular structure could have integral sleeves 35 to receive the stiffening beams 33. This allows for the stiffening beams to be made to meet different load requirements than the tubular structure. Also, the beam may be coated separately from the FFCV to render it impermeable and inflatable, allowing for a different coating for the tubular structure to be used, if so desired.

Figure 4:
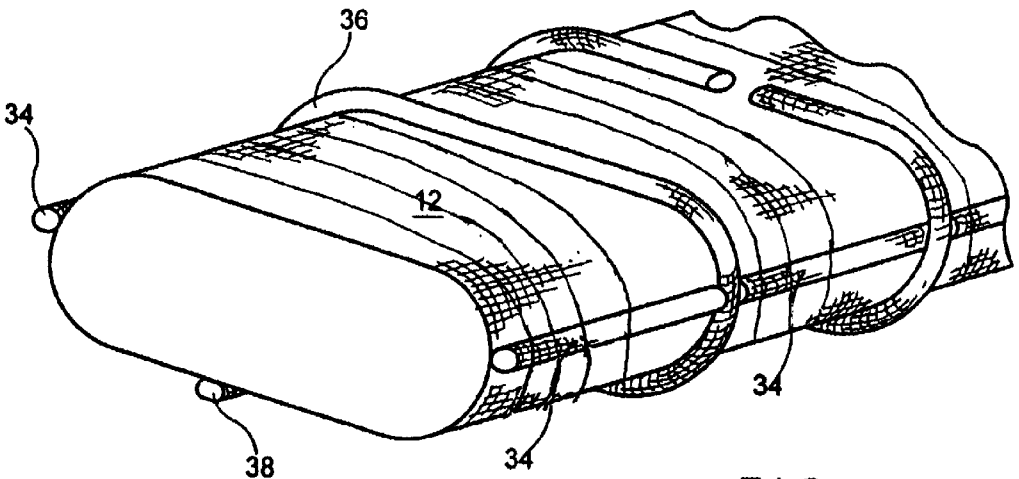
FIG. 4 is a partially sectional view of a FFCV having circumferential stiffening beams incorporating the teachings of the present invention.

Similar beams 36 can also be made to run in the cross direction to the length of the FFCV 10 as shown in FIG. 4. The beams 36 that run in the cross direction can be used to create deflectors along the side of the FFCV 10. These deflectors can break up flow patterns of salt water along the side of the FFCV 10, which, according to the prior art, leads to stable towing of the FFCV 10. See U.S. Pat. No. 3,056,373.

In addition, the beams 32 and 36, filled with pressurized air, provide buoyancy for the FFCV 10. This added buoyancy has limited utility when the FFCV 10 is filled with cargo. This added buoyancy has greater utility when the cargo is being emptied from the FFCV 10. As the cargo is removed from the FFCV 10, the beams 32 and 36 will provide buoyancy to keep the FFCV 10 afloat. This feature is especially important when the density of the FFCV 10 material is greater than salt water. If the FFCV 10 is to be wound up on a reel as the FFCV 10 is emptied, the beams 32 and 36 can be gradually deflated via bleeder valves to simultaneously provide for ease of winding and flotation of the empty FFCV 10. The gradually deflated beams 32 can also act to keep the FFCV 10 deployed in a straight fashion on the surface of the water during the winding, filling and discharging operation.

The placement or location of the beams 32 on the FFCV 10 is important for stability, durability and buoyancy of the FFCV 10. A simple configuration of two beams 32 would place the beams 32 equidistant from each other along the side of the FFCV 10 as shown in FIG. 3. If the cross sectional area of beams 32 is a small fraction of the total cross sectional area of the FFCV 10, then the beams 32 will lie below the surface of the salt water when the FFCV 10 is filled to about 50% of the total capacity. As a result the stiffening beams 32 will not be subjected to strong wave action that can occur at the surface of the sea. If strong wave action were to act on the beams 32, it is possible that the beams 32 would be damaged. Damage to the beams 32 would be detrimental to the durability of the FFCV 10. Accordingly, it is preferable that the beams 32 are located below the salt water surface when the FFCV 10 is filled to the desired carrying capacity. These same beams 32 will rise to the surface of the salt water when the FFCV 10 is emptied as long as the combined buoyancy of the beams 32 and 36 is greater than any negative buoyancy force that would cause an empty FFCV 10 to sink.

The FFCV 10 can also be made stable against rollover by placing beams in such a way that the buoyancy of the beams counteracts rollover forces. One such configuration is to have three beams. Two beams 32 would be filled with pressurized gas or air and located on the opposite sides of the FFCV 10. The third beam 38 would be filled with pressurized salt water and would run along the bottom of the FFCV 10 like a keel. If this FFCV 10 were subjected to rollover forces, the combined buoyancy of the side beams 32 and the ballast effect of the bottom beam 38 would result in forces that would act to keep the FFCV 10 from rolling over.

The beams can be made as separate woven, laid up, knit, nonwoven or braided tubes that are coated with a polymer to allow them to contain pressurized air or water. (For braiding, see U.S. Pat. Nos. 5,421,128 and 5,735,083 and an article entitled "3-D Braided Composite-Design and Applications" by D. Brookstein, $6^{th}$ European Conference on Composite Materials (September 1993).) If the beam is made as a separate tube, the beam must be attached to the main tube 12. Such a beam can be attached by a number of means including thermal welding, sewing, hook and loop attachments, gluing or pin seaming or through the use of sleeves as aforesaid.

Figure 5:
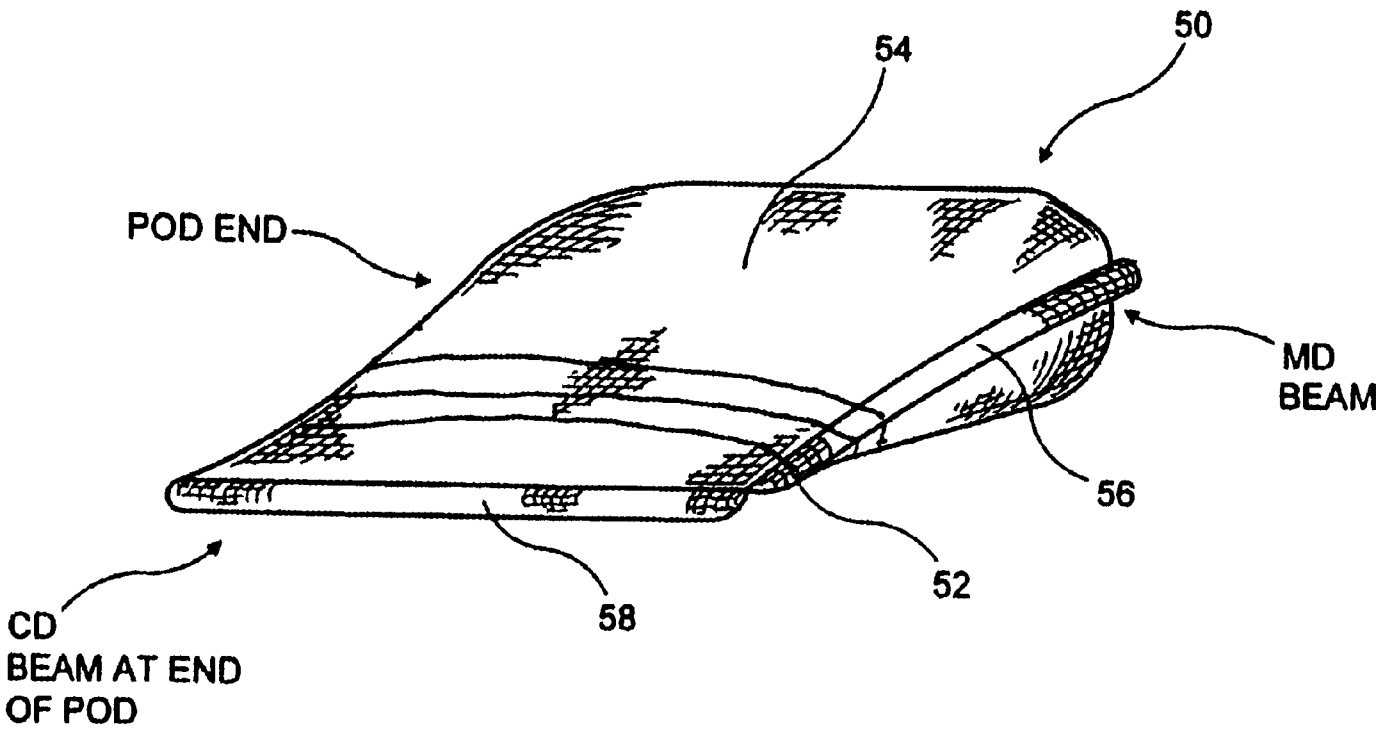
FIG. 5 is a perspective view of a pod shaped FFCV incorporating the teachings of the present invention.

The FFCV 10 can also take a pod shape 50 such as that shown in FIG. 5. The pod shape 50 can be flat at one end 52 or both ends of the tube while being tubular in the middle 54. As shown in FIG. 5, it may include stiffening beams 56 as previously discussed along its length and, in addition, a beam 58 across its end 52 which is woven integrally or woven separately and attached.

Figure 5A:
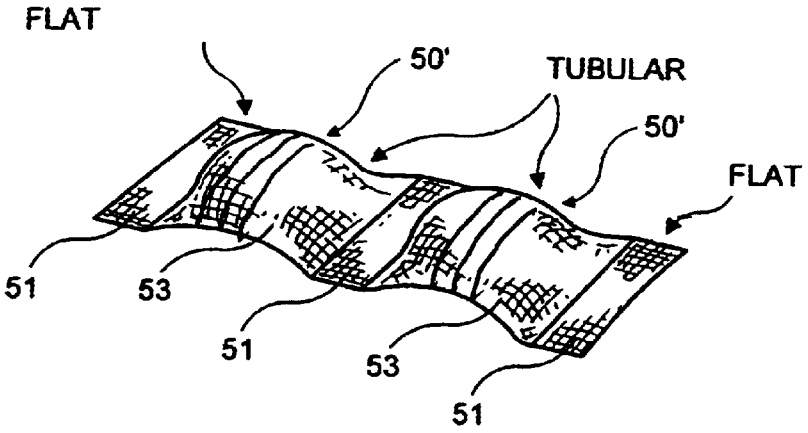
FIGS. 5A and 5B show somewhat general views of a series of pod shaped FFCVs connected by a flat structure incorporating the teachings of the present invention.
Figure 5B:
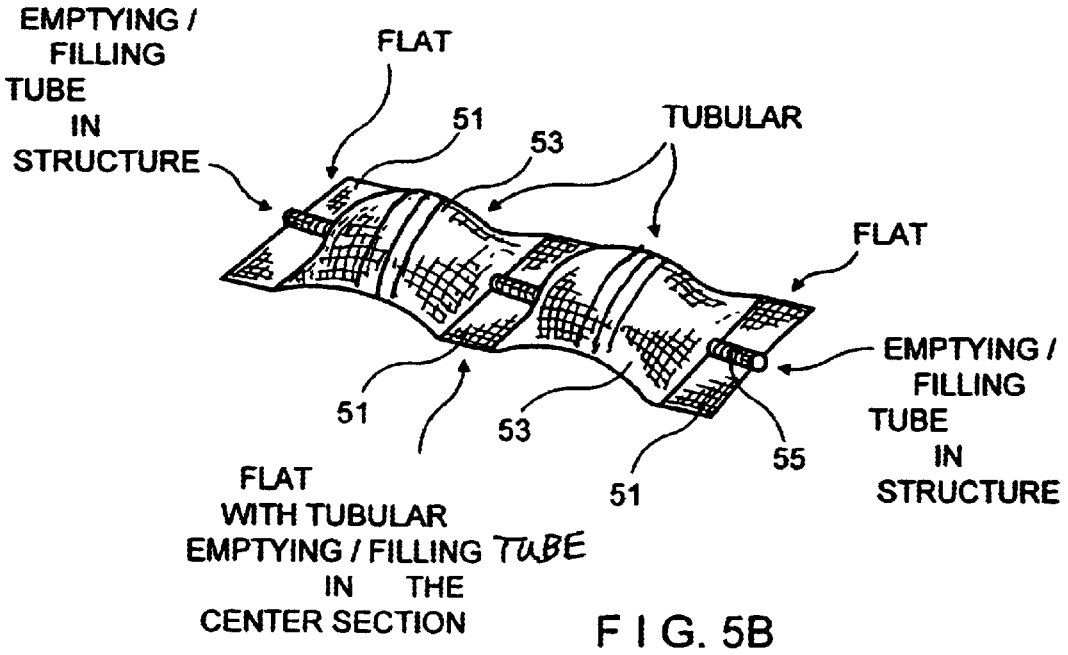

The FFCV can also be formed in a series of pods 50' as shown in FIGS. 5A and 5B. In this regard, the pods 50' can be created by a flat portion 51, then the tubular portion 53, than flat 51, then tubular 53, and so on as shown in FIG. 5A. The ends can be sealed in an appropriate manner discussed herein. In FIG. 5B there is also shown a series of pods 50' so formed, however, interconnecting the tubular portions 53 and as part of the flat portions 51, is a tube 55 which allows the pods 50' to be filled and emptied.

Figure 6:
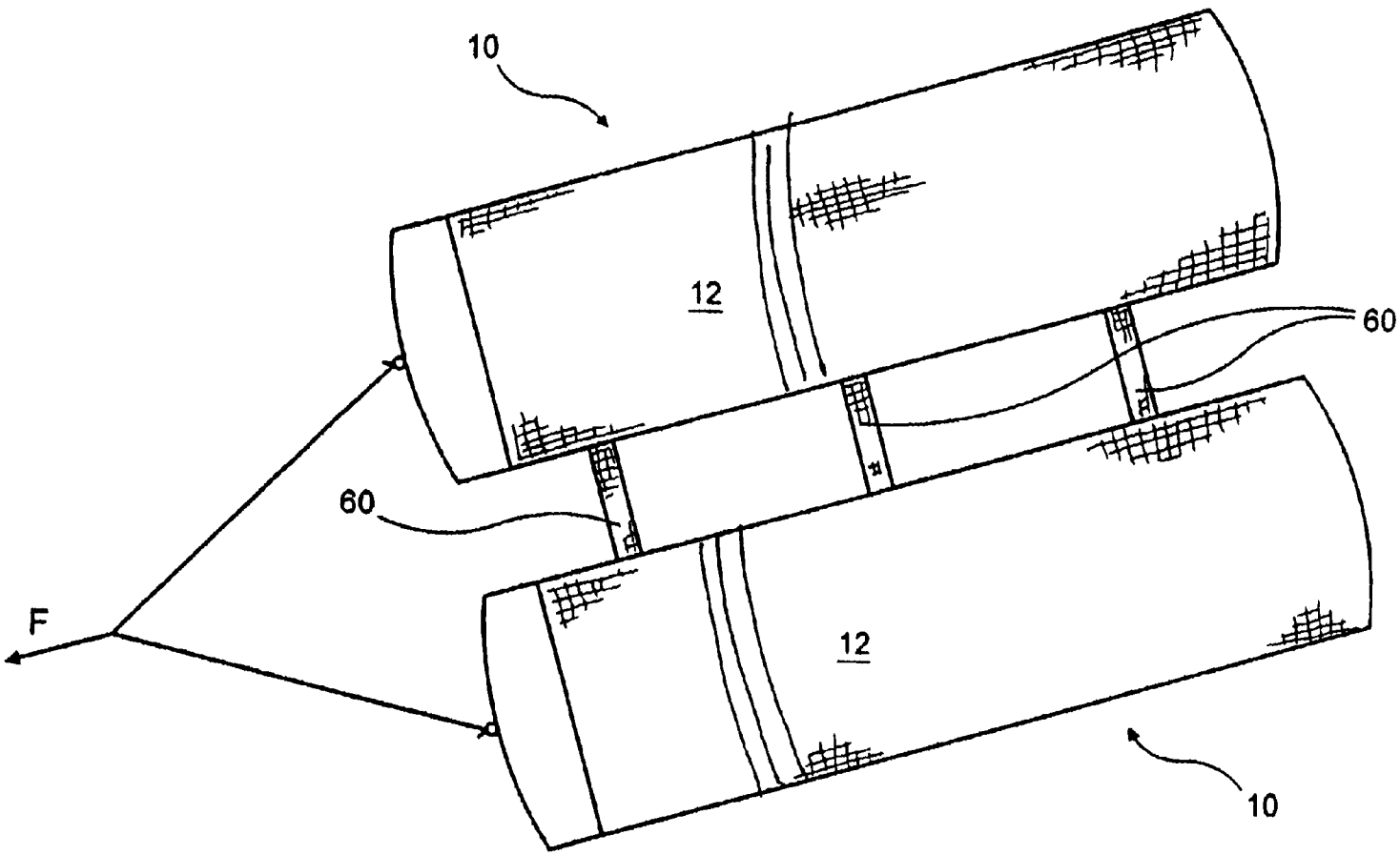
FIG. 6 is a somewhat general view of two FFCVs being towed side by side with a plurality of beam separators connected therebetween incorporating the teachings of the present invention.

Similar type beams have further utility in the transportation of fluids by FFCVs. In this regard, it is envisioned to transport a plurality of FFCVs together so as to, among other things, increase the volume and reduce the cost. Heretofore it was known to tow multiple flexible containers in tandem, side by side or in a pattern. However, in towing FFCVs side by side, there is a tendency for the ocean forces to cause lateral movement of one against the next or rollover. This may have a damaging effect on the FFCV among other things. To reduce the likelihood of such an occurrence, beam separators 60, of a construction similar to the beam stiffeners previously discussed, are coupled between the FFCVs 10 along their length as shown in FIG. 6.

The beam separators 60 could be attached by a simple mechanism to the FFCVs 10 such as by a pin seam or quick disconnect type mechanism and would be inflated and deflated with the use of valves. The deflated beams, after discharging the cargo, could be easily rolled up.

The beam separators 60 will also assist in the floatation of the empty FFCVs 10 during roll up operations, in addition to the stiffening beams 32, if utilized. If the latter was not utilized, they will act as the primary floatation means during roll up.

The beam separators 60 will also act as a floatation device during the towing of the FFCVs 10 reducing drag and potentially provide for faster speeds during towing of filled FFCVs 10. These beam separators will also keep the FFCV 10 in a relatively straight direction avoiding the need for other control mechanisms during towing.

The beam separators 60 make the two FFCVs 10 appear as a "catamaran". The stability of the catamaran is predominantly due to its two hulls. The same principles of such a system apply here.

Figure 7:
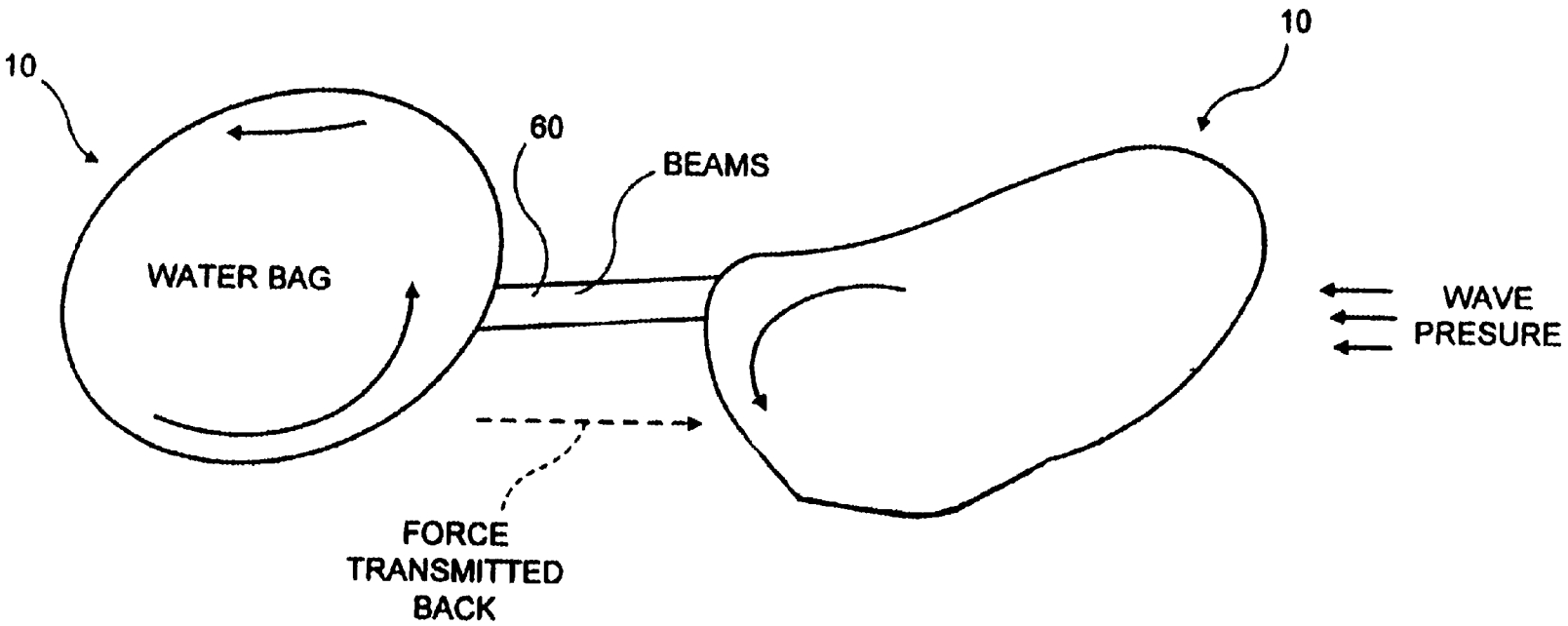
FIG. 7 is a somewhat schematic view of the force distribution on side by side FFCVs connected by beam separators incorporating the teachings of the present invention.

Stability is due to the fact that during the hauling of these filled FFCVs in the ocean, the wave motion will tend to push one of the FFCVs causing it to roll end-over-end as illustrated in FIG. 7. However, a counter force is formed by the contents in the other FFCV and will be activated to nullify the rollover force generated by the first FFCV. This counter force will prevent the first FFCV from rolling over as it pushes it in the opposite direction. This force will be transmitted with the help of the beam separators 60 thus stabilizing or self correcting the arrangement.

Turning now to the method of rendering such a large structure impermeable, the spirally-wound fabric strip formation allows the fabric strips to be pre-coated. Also, to ensure a leak free seal, it may be produced either by adding a sealant to the surface of coated material during spiral joining or using a bonding process that results in sealed bond. For example, an ultrasonic bonding or thermal bonding process (see e.g. U.S. Pat. No. 5,713,399) could be used with a thermoplastic coating to result in a leak free seal. If the fabric strips were not pre-coated, or if it was desired to coat the structure after fabrication, appropriate methods of accomplishing the same are set forth in the aforesaid patent application.

As part of the coating process there is envisioned the use of a foamed coating on the inside or outside or both surfaces of the fabric strip. A foamed coating would provide buoyancy to the FFCV, especially an empty FFCV. An FFCV constructed from materials such as, for example, nylon, polyester and rubber would have a density greater than salt water. As a result the empty FFCV or empty portions of the large FFCV would sink. This sinking action could result in high stresses on the FFCV and could lead to significant difficulties in handling the FFCV during filling and emptying of the FFCV. The use of a foam coating provides an alternative or additional means to provide buoyancy to the FFCV to that previously discussed.

Also, in view of the closed nature of the FFCV, if it is intended to transport fresh water, as part of the coating process of the inside thereof, it may provide for a coating which includes a germicide or a fungicide so as to prevent the occurrence of bacteria or mold or other contaminants.

In addition, since sunlight also has a degradation effect on fabric, the FFCV may include as part of its coating, or the fiber used to make up the fabric strips, a UV protecting ingredient in this regard.

Although preferred embodiments have been disclosed and described in detail herein, their scope should not be limited thereby rather their scope should be determined by that of the appended claims.

We claim:

1. A flexible fluid containment vessel for the transportation of cargo comprising a fluid or fluidisable material, said vessel comprising:

an elongated flexible tubular structure comprised of at least one spirally wound fabric strip having a width which is smaller than a width of the tubular structure;

means for rendering said tubular structure impervious;

said tubular structure having a front end and a rear end;

means for sealing said front end and said rear end;

means for filling and emptying said vessel of cargo; and means affixed to said vessel to allow for the towing thereof.

2. The vessel in accordance with claim 1 which includes at least one flexible longitudinal stiffening beam positioned along a length of said tubular structure for dampening undesired oscillation of said tubular structure, said at least one flexible longitudinal stiffening beam being affixed to said tubular structure and subject to pressurization and depressurization.

3. The vessel in accordance with claim 2 which includes a plurality of longitudinal stiffening beams.

4. The vessel in accordance with claim 2 which includes at least two longitudinal stiffening beams positioned equidistant from each other on the tubular structure.

5. The vessel in accordance with claim 4 which includes a third longitudinal stiffening beam positioned intermediate the at least two longitudinal stiffening beams, with said third beam being so positioned as to provide ballast when filled.

6. The vessel in accordance with claim 3 wherein said stiffening beams are continuous.

7. The vessel in accordance with claim 3 wherein said stiffening beams are made in sections.

8. The vessel in accordance with claim 1 which includes at least one flexible circumferential stiffening beam positioned about a circumference of the tubular structure and being subject to pressurization and depressurization.

9. The vessel in accordance with claim 8 which includes at a plurality of said circumferential stiffening beams.

10. The vessel in accordance with claim 8 wherein said at least one flexible circumferential stiffening beam is continuous.

11. The vessel in accordance with claim 8 wherein said at least one flexible circumferential stiffening beam is in sections.

12. The vessel in accordance with claim 1 wherein the means for sealing an end of the tubular structure comprises collapsing the end upon itself into a flatten, folded structure, sealing it and securing it mechanically.

13. The vessel in accordance with claim 1 wherein the means for sealing an end of the tubular structure comprises an end cap made of rigid material secured to a perimeter of the tubular structure defining its circumference so as to evenly distribute forces thereon.

14. The vessel in accordance with claim 1 wherein the means for sealing an end includes collapsing, folding, and sealing an end of the tubular structure such that the width of the collapsed and folded end is approximately that of the diameter of the tubular structure.

15. The vessel in accordance with claim 1 wherein the tubular structure is pod shaped having at least one end which is collapsed and sealed and includes a vertical flexible stiffening beam at the one end, which is subject to pressurization and depressurization.

16. The vessel in accordance with claim 1 wherein the at least one fabric strips is woven with fiber reinforcements with the weave used taken from the group consisting essentially of: plain weave (1×1); basket weaves including 2×2, 3×3, 4×4, 5×5, 6×6, 2×1, 3×1, 4×1, 5×1, 6×1; twill weaves including 2×2, 3×3, 4×4, 5×5, 6×6, 2×1, 3×1, 4×1, 5×1, 6×1; and satin weaves including 2×1, 3×1, 4×1, 5×1and 6×1.

17. The vessel in accordance with claim 16 wherein the fiber reinforcements are made of a material taken from the group consisting essentially of: nylon, polyesters, polyaramids, polyolefins and polybenzoxazole.

18. The vessel in accordance with claim 1 wherein said means for rendering said tubular structure impervious includes a coating material on the fabric strip on one or both sides thereof.

19. The vessel in accordance with claim 18 wherein said coating material is taken from the group consisting essentially of: polyvinyl chloride, polyurethane, synthetic and natural rubbers, polyureas, polyolefins, silicone polymers, acrylic polymers or foam derivatives thereof.

20. The vessel in accordance with claim 17 wherein said means for rendering said tubular structure impervious includes a coating material on the at least one fabric strips on one or both sides thereof.

21. The vessel in accordance with claim 20 wherein said coating material is taken from the group consisting essentially of: polyvinyl chloride, polyurethane, synthetic and natural rubbers, polyureas, polyolefins, silicone polymers, acrylic polymers or foam derivatives thereof.

22. The vessel in accordance with claim 1 which includes at least two vessels positioned in a side by side relationship, a plurality of beam separators positioned between and coupled to said two vessels, said beam separator being made of flexible material and subject to pressurization and depressurization.

23. The vessel in accordance with claim 1 wherein said at least one fabric strips is made of a coated or uncoated woven fabric, coated or uncoated knit fabric, coated or uncoated non-woven fabric, or coated or uncoated netting.

24. A flexible fluid containment vessel for the transportation and/or containment of cargo comprising a fluid or fluidisable material, said vessel comprising:

an elongated flexible tubular structure comprised of at least one spirally wound fabric strip having a width which is smaller than a width of the tubular structure;

means for rendering said tubular structure impervious;

said tubular structure having a front end and a rear end;

means for sealing said front end and said rear end;

means for filling and emptying said vessel of cargo; and means for reinforcing the tubular structure by forming pockets to receive reinforcement elements at predetermined intervals along a longitudinal length of the tubular structure.

25. The vessel in accordance with claim 24 wherein said reinforcing means further comprises pockets at predetermined intervals about a circumference of the tubular structure.

26. The vessel in accordance with claim 25 wherein the reinforcing element comprises rope, braid or wire.

27. The vessel in accordance with claim 24 wherein the means for sealing an end of the tubular structure comprises collapsing the end upon itself into a flatten, folded structure, sealing it and securing it mechanically.

28. The vessel in accordance with claim 24 wherein the means for sealing an end of the tubular structure comprises an end cap made of rigid material secured to a perimeter of the tubular structure defining its circumference so as to evenly distribute forces thereon.

29. The vessel in accordance with claim 24 wherein the means for sealing an end includes collapsing, folding, and sealing an end of the tubular structure such that the width of the collapsed and folded end is approximately that of the diameter of the tubular structure.

30. The vessel in accordance with claim 24 wherein the tubular structure is pod shaped having at least one end which is collapsed and sealed and includes a vertical flexible stiffening beam at the one end, which is subject to pressurization and depressurization.

31. The vessel in accordance with claim 24 wherein the at least one fabric strips is woven with fiber reinforcements with the weave used taken from the group consisting essentially of: plain weave (1×1); basket weaves including 2×2, 3×3, 4×4, 5×5, 6×6, 2×1, 3×1, 4×1, 5×1, 6×1; twill weaves including 2×2, 3×3, 4×4, 5×5, 6×6, 2×1, 3×1, 4×1, 5×1, 6×1; and satin weaves including 2×1, 3×1, 4×1, 5×1and 6×1.

32. The vessel in accordance with claim 31 wherein the fiber reinforcements are made of a material taken from the group consisting essentially of: nylon, polyesters, polyaramids, polyolefins and polybenzoxazole.

33. The vessel in accordance with claim 24 wherein the at least one fabric strips is woven with fiber reinforcements which are made of a material taken from the group consisting essentially of: nylon, polyesters, polyaramids, polyolefins and polybenzoxazole.

34. The vessel in accordance with claim 24 wherein said means for rendering said tubular structure impervious includes a coating material on the at least one fabric strips on one or both sides thereof.

35. The vessel in accordance with claim 34 wherein said coating material is taken from the group consisting essentially of: polyvinyl chloride, polyurethane, synthetic and natural rubbers, polyureas, polyolefins, silicone polymers, acrylic polymers or foam derivatives thereof.

36. The vessel in accordance with claim 32 wherein said means for rendering said tubular structure impervious includes a coating material on the fabric on one or both sides thereof.

37. The vessel in accordance with claim 36 wherein said coating material is taken from the group consisting essentially of: polyvinyl chloride, polyurethane, synthetic and natural rubbers, polyureas, polyolefins, silicone polymers, acrylic polymers or foam derivatives thereof.

38. A flexible fluid containment vessel for the transportation and/or containment of cargo comprising a fluid or fluidisable material, said vessel comprising:

an elongated flexible tubular structure comprised of at least one spirally wound fabric strip having a width which is smaller than a width of the tubular structure;

means for rendering said tubular structure impervious;

said tubular structure having a front end and a rear end;

means for sealing said front end and means for sealing said rear end;

means for forming said front end and means for forming said rear end;

means for filling and emptying said vessel of cargo; and wherein the means for forming said front end includes creating a conical end portion formed out of fabric strip having a gradient over a width from one edge to an opposite edge of the fabric strip.

39. The vessel in accordance with claims 38 wherein said means for sealing said front end includes securing said front end mechanically.

40. The vessel in accordance with claim 38 wherein said means for forming said rear end includes creating a conical end portion formed out of the at least one fabric strips-having a gradient over a width from one edge to an opposite edge of the at least one fabric strip.

41. The vessel in accordance with claim, 38 wherein said means for sealing said rear end includes securing said rear end mechanically.

42. A flexible fluid containment vessel for the transportation and/or containment of cargo comprising a fluid or fluidisable material, said vessel comprising:

at least two elongated flexible tubular structures comprised of at least one spirally wound fabric strip having a width which is smaller than a width of the tubular structures;

means for rendering said at least two elongated flexible tubular structures impervious;

said at least two elongated flexible tubular structures having a respective front end and a rear end;

means for sealing said respective front end and said rear end;

means for filling and emptying said vessel of cargo; and means for connecting said tubular structures together in a series comprising flat fabric positioned between said tubular structures.

43. The vessel in accordance with claim 42 wherein said means for filling and emptying comprises a tube connecting said at least two elongated flexible tubular structures allowing fluid communication therebetween.

44. The vessel in accordance with claim 43 wherein said means for filling and emptying further comprises a tube at respective front end of one of said at least two tubular structures and a respective rear end of the other of said at least two tubular structures.

45. The vessel in accordance with claim 42 wherein said at least two tubular structures are pod shaped.

46. A flexible fluid containment vessel for the transportation and/or containment of cargo comprising a fluid or fluidisable material, said vessel comprising:

an elongated flexible tubular structure comprised of at least one spirally wound fabric strip having a width which is smaller than a width of the tubular structure;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said at least one stiffening beam being maintained within a sleeve on said tubular structure along a length thereof and subject to pressurization and depressurization.

47. The vessel in accordance with claim 46 which includes a plurality of longitudinal stiffening beams and a plurality of sleeves.

48. The vessel in accordance with claim 47 which includes at least two longitudinal stiffening beams positioned equidistant from each other on the tubular structure which are maintained in respective sleeves.

49. The vessel in accordance with claim 47 wherein said stiffening beams are continuous and said sleeves are continuous.

50. The vessel in accordance with claim 1 which includes a germicide or fungicide on the inside of the tubular structure.

51. The vessel in accordance with claim 24 which includes a germicide or fungicide on the inside of the tubular structure.

52. The vessel in accordance with claim 38 which includes a germicide or fungicide on the inside of the tubular structure.

53. The vessel in accordance with claim 42 which includes a germicide or fungicide on the inside of said at least two tubular structures.

54. The vessel in accordance with claim 46 which includes a germicide or fungicide on the inside of the tubular structure.

55. The vessel in accordance with claim 1 which includes a UV protecting ingredient on the outside of the tubular structure.

56. The vessel in accordance with claim 24 which includes a UV protecting ingredient on the outside of the tubular structure.

57. The vessel in accordance with claim 36 which includes a UV protecting ingredient on the outside of the tubular structure.

58. The vessel in accordance with claim 42 which includes a UV protecting ingredient on the outside of said at least two tubular structures.

59. The vessel in accordance with claim 46 which includes a UV protecting ingredient on the outside of the tubular structure.

* * * * *